US007922002B2

(12) United States Patent
Braunstein

(10) Patent No.: US 7,922,002 B2
(45) Date of Patent: Apr. 12, 2011

(54) KIT FOR PRODUCING JEWELRY WITH CODED MESSAGES

(76) Inventor: Marci Braunstein, Long Valley, NJ (US)

( * ) Notice: Subject to any disclaimer, the term of this patent is extended or adjusted under 35 U.S.C. 154(b) by 34 days.

(21) Appl. No.: 12/386,375

(22) Filed: Apr. 17, 2009

(65) Prior Publication Data

US 2010/0264056 A1 Oct. 21, 2010

(51) Int. Cl.
*B65D 69/00* (2006.01)

(52) U.S. Cl. ..... 206/575; 206/6.1; 206/579; 63/38

(58) Field of Classification Search ..... 206/575, 206/579, 6.1, 566; 63/35, 38, 3
See application file for complete search history.

(56) References Cited

U.S. PATENT DOCUMENTS

| | | | | |
|---|---|---|---|---|
| 706,002 | A * | 8/1902 | Allen | 400/487 |
| 4,022,318 | A * | 5/1977 | Goodman | 206/223 |
| 4,458,238 | A * | 7/1984 | Learn | 341/20 |
| 5,482,159 | A * | 1/1996 | Roraback et al. | 206/223 |
| 6,083,267 | A * | 7/2000 | Motomiya et al. | 703/6 |
| 6,442,972 | B1 * | 9/2002 | Watson | 63/38 |
| 6,553,786 | B1 | 4/2003 | Kwiat | |
| 6,928,835 | B1 * | 8/2005 | Cousin et al. | 63/39 |
| 7,155,933 | B2 | 1/2007 | Pourmehdi | |
| 7,443,316 | B2 * | 10/2008 | Lim | 341/22 |
| 2003/0136149 | A1 * | 7/2003 | Logan et al. | 63/35 |
| 2004/0198138 | A1 * | 10/2004 | Vasic et al. | 446/71 |
| 2005/0163898 | A1 * | 7/2005 | Romanach et al. | 426/383 |

* cited by examiner

*Primary Examiner* — David T Fidei
(74) *Attorney, Agent, or Firm* — Daniel Kirshner

(57) ABSTRACT

A kit for making jewelry encoded with a secret message. The kit includes a plurality of beads, each bead having an indicator corresponding to an alpha-numeric symbol. The beads are grouped together and held in a container having separate compartments for each grouping. Threads for stringing together the beads are provided and may be elasticized. A first user chooses beads and assembles them in a predetermined order onto a thread to make an article of jewelry. The predetermined order is chosen to encode a secret message. A second user utilizes a decoder to decode the secret message. Two different decoders may be utilized to decode the message. The first is a card depicting each color bead with its corresponding symbol. The second is a device having an individual keyboard key for each alphanumeric symbol where a depiction of each of the beads is shown on the keyboard key.

1 Claim, 3 Drawing Sheets

KIT FOR PRODUCING JEWELRY WITH CODED MESSAGES

FIELD OF THE INVENTION

The present invention relates to jewelry and more specifically to kit for a person to produce articles of jewelry with encoded messages which kit also includes a decoding device.

SUMMARY OF THE INVENTION

The present invention is a kit for making jewelry which jewelry is encoded with a secret message chosen by the jewelry maker. The jewelry kit includes a plurality of beads, each bead has an indicator which corresponds to an alpha-numeric symbol (i.e., a letter, a number, the space between words and a separate indicator bead which indicates the starting point of a message.) The beads are grouped together and are typically held in a container which container has separate compartments for each grouping of beads. Strands or threads for stringing together the beads are also provided as part of the kit and the strands may be elasticized. A first user chooses beads and assembles them onto a thread to make an article of jewelry whereby the first user places the beads in a predetermined order. The predetermined order is chosen to encode a secret message. Now a second user utilizes a decoder device to decode the secret message encoded onto the article of jewelry. There are two decoders which can be utilized to decode the message. The first is a card depicting each color bead with its corresponding symbol. The second decoder in the preferred embodiment is a device having an individual keyboard key for each of the alphanumeric symbols where a depiction of each of the beads is shown on the face of the keyboard key. The decoder further includes a screen for displaying the decoded message and may also print a print-out of the decoded message.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 2A:
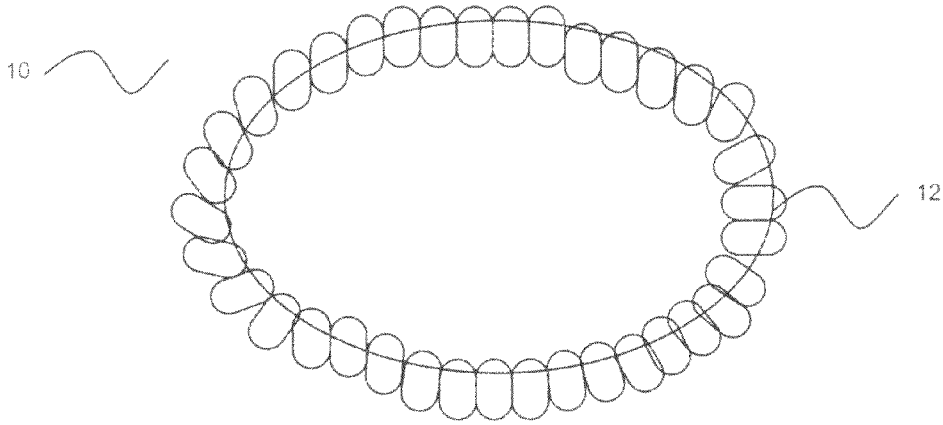
FIG. 2A is an encoded beaded article of jewelry made by a user in accordance with the present invention.
Figure 2B:
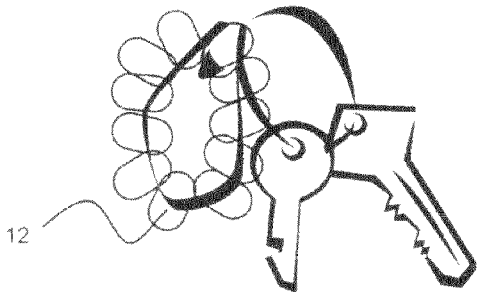
FIG. 2B is an encoded beaded article of jewelry made by a user in accordance with the present invention formed into a keychain.
Figure 2C:
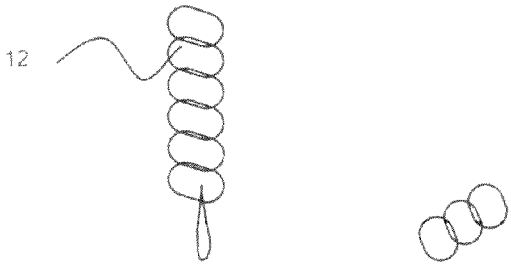
FIG. 2C is an encoded beaded article of jewelry made by a user in accordance with the present invention formed into a sneaker decoration.
Figure 2D:
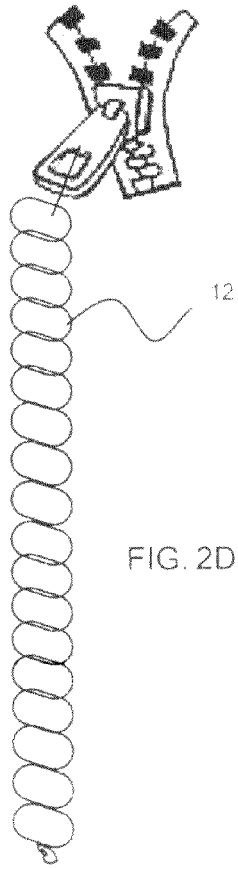
FIG. 2D is an encoded beaded article of jewelry made by a user in accordance with the present invention formed into a zipper pull.

The present invention is a kit that is utilized for making jewelry at a get together, at home, at a party, fund raiser, convention or the like. In making an article of jewelry, the user encodes the said jewelry with a code that can thereafter be decoded to convey a message. Generally, the kit comprises a plurality of beads 12 grouped together by various indicia, one or more strands or treads onto which the beads are arranged in a predetermined order to encode a message into an article of jewelry 10 as shown in FIG. 2A, and a decoder device 17 for decoding the message displayed by each beaded strand. In addition, a container 14 may be provided for retaining the beads in various compartments, the beads separated into the various compartments according to the indicia thereon.

Figure 1:
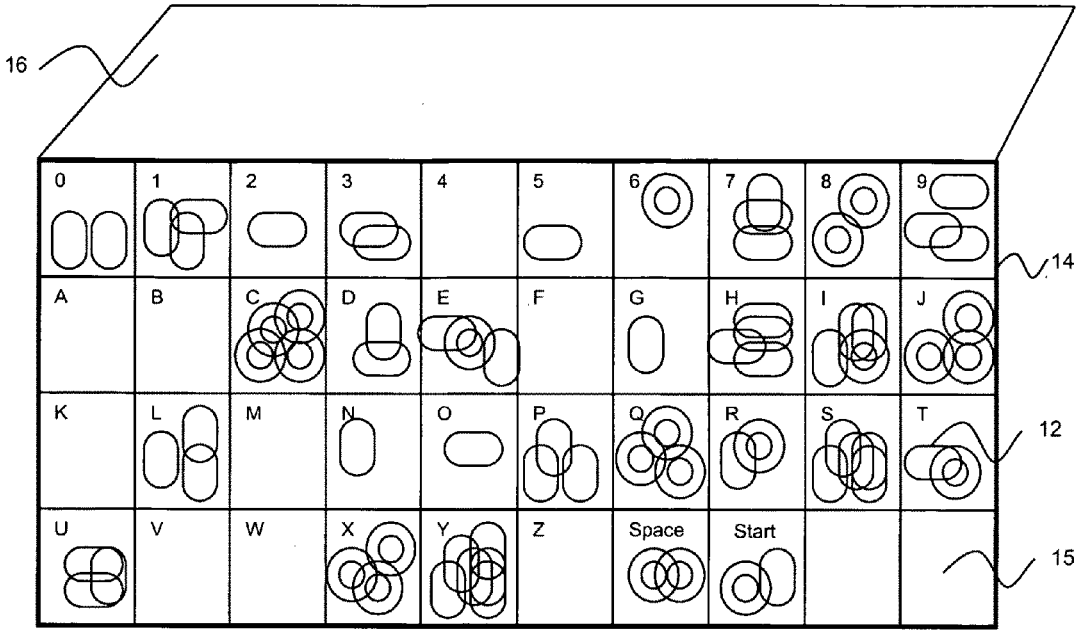
FIG. 1 is a top view of the beads of the present invention, each bead encoded to represent an alpha-numeric symbol, all of the bead contained in a compartmentalized lidded-container.

FIG. 1 show a plurality of beads 12 separated into various groupings all aggregated into a container 14. The beads are typically manufactured from plastic, but may also be formed from wood, metal or the like. Each of the grouping of beads has a indicator, each indicator representing an alpha-numeric symbol. For example, each grouping of beads may be formed from a different color of plastic. As such, each different color bead represents one letter of the alphabet, or one of the digits 0 through 9. (A bead of an additional distinct color should be provided which bead represents the space between words, and another distinct color bead signifies the starting point of the message.) In another embodiment of the present invention, each grouping of beads can be divided into beads formed in a distinct shape or configuration, each distinctly-shaped bead representing a letter, number or space. In any of the embodiments, each of the beads must include a hole or stringing aperture for stringing the beads together onto a thread or elastic band.

The container 14 is shown in FIG. 1 which container includes compartments 15. Each grouping of beads representing an alpha-numeric symbol is retained within its own compartment. The container may be formed from plastic or other such rigid material and should preferably include an optional attached, hinged lid 16 as shown in FIG. 1 which hinging would be omitted in the event the lid is detachable. As shown in the figure, each compartment of the container is marked with the alpha-numeric symbol to which the beads contained therein correspond.

Users, which users are usually children, at home, or attending a party or gathering, select a thread or an elasticized band for stringing together the encoded beads. The children choose beads to represent each of the letters or numbers that they desire in order to convey a message on the article of jewelry. As an example, a red bead could be utilized to represent the letter 'l', a blue bead could be utilized to represent the letter 'o', a green bead could be utilized to represent the letter 'v', and a yellow bead could be utilized to represent the letter 'e'. Thus, if the child strings the beads onto the elastic band in the order: red bead-blue bead-green bead-yellow bead, the word "love" is encoded. As is evident, in the case of messages that comprise more than one word, the bead representing the space between words should be utilized, and a bead signifying the message starting point would be placed prior to placing the other beads. The children choose the appropriate beads to spell out their predetermined message, then string the beads onto the stringing strand by threading the strand through the stringing aperture in the correct order to spell out the chosen message. Finally, the end of the strand is formed into a knot or other jewelry closure thereby retaining the beads on the strand in the correct order, completing the article of jewelry 10 and spelling out the chosen message.

Figure 3A:
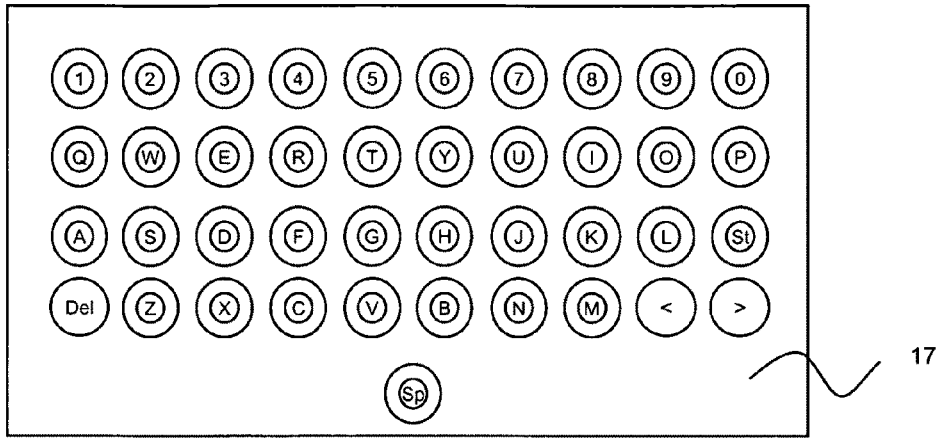
FIG. 3A is a decoder card as disclosed by the present invention.
Figure 3B:
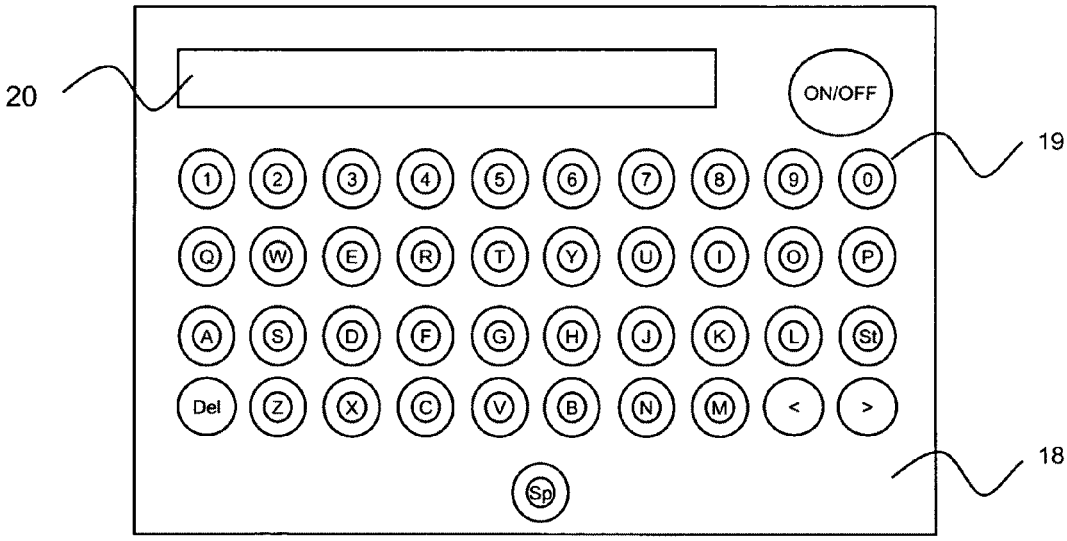
FIG. 3B is a decoder device as disclosed by the present invention.

The fun times are expanded when other users (i.e. children) decode the messages that are encoded. In order to perform the decoding operation, a de-coder is provided. Included in the kit is a card depicting each color bead with its corresponding symbol, as depicted in FIG. 3A. One embodiment of the decoder is shown in FIG. 3A which is a card 17 depicting each color bead with its corresponding symbol. An optional electronic decoder can also be used to decode the beaded message. In the embodiment shown in FIG. 3B, the de-coder takes the form of a label maker 18. The label maker is similar to a typical off-the-shelf label maker, except that each key only represents a single character whereas label makers employ a shift key which enables keys to represent more than one character. Each key also includes the color of the bead the character represents. Prior art label makers are well known and typically include keys for each letter of the alphabet, a shift key which enable the user to select the digits 0 through 9, and a space bar key. A user employs such prior art label makers by entering a series of keystrokes into the label maker, the message is displayed onto an LCD screen and then printed onto a label if desired.

As an optional part of the kit of the present invention, each alpha-numeric key on the label maker is modified to show a representation (e.g. picture) of the bead that corresponds to the number, letter or space. In other words, either an actual bead or a picture of the bead is attached to the label maker's key to which that particular bead corresponds.

Now, one user can decode the message on the article of jewelry made by another user. One child examines the jewelry produced by another child. Bead by bead, the first user enters the keystrokes onto the keys 19 of the decoding device, each keystroke entered according to the indicator contained on the bead. As such, the coded message will be decoded, letter by letter, displayed onto the display 20 of the decoder and printed onto a label if desired.

The present invention is not limited to decoding devices taking the form of a label maker. Other decoding devices are contemplated in this disclosure. For example, a decoding display placard may contain a photograph or a drawing of each bead, along with the alpha-numeric symbol with which it corresponds. Alternatively, the code may simply be printed onto paper or stored in a computer or the memory of a cellular telephone in order that the codes may be decoded by other users.

Primarily, the articles of jewelry made by the children are bracelets. However, other beaded article made by produced, as shown in FIGS. 2A through 2D. For example, the present invention can be utilized to produce anklets, key chains, zipper pulls, headbands, decorative bands for shoes, etc.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed is:

1. A kit for making jewelry wherein said jewelry is encoded with a message, said kit comprising:

a plurality of uniformly sized and shaped beads, each bead coded with an indicator wherein the indicator on each bead is a color chosen to represent an alpha numeric symbol wherein beads are provided with colors representing each of the letters of an alphabet, each of the numbers 0 through 9, the space between words, and the beginning point of a message, each bead including a stringing aperture;

at least one strand for stringing said beads into an article of jewelry, the beads arranged into a predetermined order on said strand by stringing the strand through said stringing aperture thereby encoding a message;

a decoding device for decoding the encoded message on the article of jewelry, said decoding device having a key displaying the color of each encoded bead and corresponding to an alpha-numeric symbol, said decoding device further including a display screen for displaying the decoded message; and a container for retaining said beads, the container having compartments for separating said beads into groupings of beads bearing the predetermined codes, said container including one compartment for each of the differently colored beads;

whereby a first user forms an article of jewelry encoded with a message by choosing the order that the encoded beads are arranged onto the said strand, and whereby a second user decodes the encoded message utilizing the decoding device.

* * * * *